US009854863B2

(12) United States Patent
Cook

(10) Patent No.: US 9,854,863 B2
(45) Date of Patent: Jan. 2, 2018

(54) HEAD AND NECK SUPPORT AND RESTRAINT SYSTEM

(71) Applicant: Jonathan Cook, Celina, TX (US)

(72) Inventor: Jonathan Cook, Celina, TX (US)

( * ) Notice: Subject to any disclaimer, the term of this patent is extended or adjusted under 35 U.S.C. 154(b) by 27 days.

(21) Appl. No.: 15/121,298

(22) PCT Filed: Feb. 12, 2016

(86) PCT No.: PCT/US2016/017840

§ 371 (c)(1),
(2) Date: Aug. 24, 2016

(87) PCT Pub. No.: WO2016/130973

PCT Pub. Date: Aug. 18, 2016

(65) Prior Publication Data

US 2017/0013905 A1 Jan. 19, 2017

Related U.S. Application Data

(60) Provisional application No. 62/115,281, filed on Feb. 12, 2015.

(51) Int. Cl.
*A42B 3/04* (2006.01)
*A63B 71/12* (2006.01)
(Continued)

(52) U.S. Cl.
CPC ..... *A42B 3/0473* (2013.01); *A41D 13/0512* (2013.01); *A63B 71/081* (2013.01);
(Continued)

(58) Field of Classification Search
CPC ..... A42B 3/0473; A42B 3/06; A42B 3/064; A42B 3/08; A42B 3/085; A42B 3/127;
(Continued)

(56) References Cited

U.S. PATENT DOCUMENTS 5,517,699 A * 5/1996 Abraham, II ..... A42B 3/0473 2/205
7,189,192 B2 * 3/2007 Edgeton ..... A63B 21/055 482/10
(Continued)

FOREIGN PATENT DOCUMENTS

WO WO2011149895 12/2011

OTHER PUBLICATIONS

Futterman, Matthew, Rethinking the Next-Generation Helmet, Article, Dec. 24, 2015, The Wall Street Journal.

*Primary Examiner* — Bobby Muromoto, Jr.
(74) *Attorney, Agent, or Firm* — Ross Barnes LLP; Monty L. Ross; Robin L. Barnes

(57) ABSTRACT

A head and neck support and restraint system including protective headwear worn by a user; an article worn about the shoulders, chest and back of the user; and a dynamic connector that is disposed between and attached to the protective headwear and the worn article that dampens and distributes forces to which the head and neck are subjected during use. Such forces can include forces experienced as a result of acceleration, deceleration, or impact during a collision between the user and another person or object. The dynamic connector also supports and limits the rate and range of motion permitted between the head and neck relative to the shoulders, chest and back of a user when the head or body of the user is subjected to such forces.

20 Claims, 5 Drawing Sheets

(51) Int. Cl.

| | |
|---|---|
| ***A41D 13/05*** | (2006.01) |
| ***A63B 71/08*** | (2006.01) |
| ***A63B 71/10*** | (2006.01) |
| *A42B 3/00* | (2006.01) |

(52) U.S. Cl.
CPC ..... *A63B 71/10* (2013.01); *A63B 71/12* (2013.01); *A63B 71/1291* (2013.01); *A63B 2071/1208* (2013.01); *A63B 2220/53* (2013.01); *A63B 2225/50* (2013.01); *A63B 2225/52* (2013.01); *A63B 2243/007* (2013.01)

(58) Field of Classification Search
CPC ..... A41D 13/0512; A41D 2600/102; A41D 13/0568; A41D 13/0015; A41D 13/015; A41D 13/05; A41D 13/0531; A41D 19/01523; B60R 2021/0086; B60R 2021/0048; B60R 19/18; B60R 2019/186; B60R 22/00; B60R 2021/0206; B60R 21/02; B60R 22/02; B60R 22/12; B60R 22/28; B60R 22/34; A63B 71/12191; A63B 71/081; A63B 2102/14; A63B 2243/007; A63B 21/00061; A63B 21/0442; A63B 21/0557; A63B 21/4003; A63B 2220/40; A63B 2220/51; A63B 23/025; A63B 71/10
See application file for complete search history.

(56) References Cited

U.S. PATENT DOCUMENTS 7,234,210 B2 * 6/2007 Stiles ..... A41D 13/0512 2/411
7,371,221 B1 * 5/2008 Baker ..... A61F 5/055 602/18
7,426,763 B2 * 9/2008 Mazzei ..... A61G 13/12 5/622
7,608,052 B1 * 10/2009 Baker ..... A61F 5/055 128/DIG. 23
7,823,925 B2 * 11/2010 Sargent ..... A42B 3/0473 180/274
8,172,328 B2 * 5/2012 Ferro Montiu ..... B60N 2/4805 297/392
8,181,281 B2 5/2012 Nagely et al.
8,393,017 B2 * 3/2013 Sheren ..... A41D 13/0512 2/425
8,640,289 B2 * 2/2014 Reeder, Jr. ..... A47D 13/08 5/621
8,834,394 B2 9/2014 Ghajar
8,850,625 B2 * 10/2014 Stiles ..... A42B 3/0473 2/421
8,918,918 B2 * 12/2014 Jackson ..... A42B 3/0473 2/425
9,173,660 B2 * 11/2015 Smith ..... A61B 17/1325
9,205,320 B2 12/2015 Mason
9,241,528 B2 * 1/2016 Partlo ..... A42B 3/0473
9,415,711 B2 * 8/2016 Darnell ..... A41D 13/0512
9,700,094 B2 * 7/2017 Nagely ..... A42B 3/0473
9,700,125 B2 * 7/2017 Leslie ..... A45F 5/00
2001/0002087 A1 * 5/2001 Townsend ..... A42B 3/0473 280/801.1
2002/0069451 A1 * 6/2002 Yamaguchi ..... A45C 7/0059 2/338
2004/0058780 A1 * 3/2004 Edgeton ..... A63B 21/055 482/10
2004/0216206 A1 * 11/2004 Schroth ..... A42B 3/0473 2/459
2004/0255368 A1 * 12/2004 Baker ..... A42B 3/0473 2/410
2005/0015858 A1 * 1/2005 Ashline ..... A42B 3/0473 2/421
2005/0204457 A1 * 9/2005 Stiles ..... A41D 13/0512 2/425
2005/0206151 A1 * 9/2005 Ashline ..... A42B 3/0473 280/801.1
2005/0262618 A1 * 12/2005 Musal ..... A42B 3/145 2/417
2006/0053556 A1 * 3/2006 Piontek ..... A61F 5/3707 5/637
2006/0217648 A1 * 9/2006 Rogachevsky ..... A61F 5/055 602/20
2007/0010771 A1 * 1/2007 Leatt ..... A41D 13/0512 602/18
2007/0067896 A1 * 3/2007 Sargent ..... A42B 3/0473 2/468
2007/0156072 A1 * 7/2007 Leatt ..... A41D 13/0512 602/18
2008/0104763 A1 * 5/2008 Brown ..... A61G 7/0573 5/636
2009/0229042 A1 * 9/2009 Stiles ..... A41D 13/0512 2/421
2009/0307830 A1 * 12/2009 Sargent ..... A42B 3/0473 2/468
2010/0229290 A1 * 9/2010 Nelson ..... A42B 3/0473 2/425
2010/0263112 A1 * 10/2010 Mazzarolo ..... A41D 13/0512 2/468
2010/0281606 A1 * 11/2010 Kordecki ..... A41D 13/0512 2/462
2011/0004980 A1 * 1/2011 Leatt ..... A42B 3/0473 2/424
2011/0030113 A1 * 2/2011 Imholt ..... A42B 3/16 2/6.7
2011/0041240 A1 * 2/2011 Mazzarolo ..... A41D 13/0512 2/468
2011/0072567 A1 3/2011 Duhame
2012/0278977 A1 * 11/2012 Rocklin ..... A42B 3/085 2/421
2013/0031706 A1 2/2013 Cooksey
2013/0036538 A1 * 2/2013 Sheren ..... A41D 13/0512 2/461
2013/0104295 A1 * 5/2013 Darnell ..... B60N 2/4805 2/410
2014/0053324 A1 * 2/2014 Jackson ..... A42B 3/0473 2/425
2014/0081601 A1 * 3/2014 Zhang ..... A42C 2/00 703/1
2014/0237707 A1 8/2014 Lane
2014/0277101 A1 * 9/2014 Smith ..... A61B 17/1325 606/202
2015/0245680 A1 * 9/2015 Partlo ..... A42B 3/046 2/411
2016/0158630 A1 * 6/2016 Stiles ..... A63B 71/1291 2/468
2016/0309808 A1 * 10/2016 Armour ..... A41D 13/0512
2016/0369861 A1 * 12/2016 Phipps ..... B60R 19/28
2017/0100659 A1 * 4/2017 Blecher ..... A63B 71/081
2017/0119106 A1 * 5/2017 Leslie ..... A41B 9/007
2017/0251742 A1 * 9/2017 Partlo ..... A42B 3/0473

* cited by examiner

HEAD AND NECK SUPPORT AND RESTRAINT SYSTEM

CROSS-REFERENCE TO RELATED APPLICATION

This application claims the benefit of U.S. Provisional Patent Application No. 62/115,281, filed Feb. 12, 2015.

TECHNICAL FIELD AND BACKGROUND OF THE INVENTION

1. Field of the Invention

This invention relates to a system and apparatus useful for supporting and protecting the head (including without limitation the face, skull and brain) and neck of a user by damping and distributing forces to which they would otherwise be subjected during sudden acceleration, deceleration or impact. Such forces can arise, for example, during a collision between the user and an animate or inanimate object, no matter whether accidental or intentional.

2. Description of Related Art

In recent years much attention has been drawn to the causes and effects of head, neck and brain injuries due to concussive forces experienced by persons engaged in activities such as, for example and without limitation: football; baseball; soccer; hockey; lacrosse; boxing; bull riding; skiing; snowboarding; skateboarding; sky-diving; base jumping; bicycling; motorcycling; riding all-terrain vehicles; car or boat racing; piloting aircraft; performing military, law-enforcement or fire-fighting operations or maneuvers; other vehicular maneuvers, fire-fighting, and the like. Historically, efforts to lessen the risk or likelihood of serious physiological injury when engaging in such activities have focused on providing a helmet or other headwear comprising one or more of an outer shell or cover in combination with cushioning pads, collapsible layers, or other impact-absorbing structures or materials intended to protect the head of the user from impact or injury.

Despite the improvements to headwear that have been made in recent years, such devices or apparatus are still typically configured in such manner that the neck is required to support the weight of both the head and the protective headwear, sometimes supplemented by neck cushions or collars disposed or worn between the head and shoulders of the user. Because the weight of the prior art protective headwear is supported primarily by the neck of the user, designers are further constrained in the design of headwear by the need to make the headwear relatively lightweight or risk further physiological damage or injury due to the combined weight of the head and headwear. Also, conventional protective headwear typically does not limit either the rate or range of motion of the head or neck relative to other parts of the body when subjected to acceleration, deceleration or impact.

A system and apparatus are needed that will support the head and neck, and supplement the protective features of conventional headwear by dampening and dissipating forces otherwise applied to the head and neck during a collision or impact; by distributing the dissipated forces to the shoulders, chest and back of a user without passing through and risking injury to the neck and cervical vertebrae; and by limiting the rate and range of motion permitted to the head and neck relative to the shoulders, chest and back of a user.

SUMMARY OF THE INVENTION

The subject system and apparatus are useful for avoiding or limiting physiological and neurological damage or injury when the user engages in or performs activities that are vocational, avocational or recreational without regard to whether such collisions are intentional or accidental in nature. The subject system and apparatus will support head and neck of a user and desirably permit rotational, tilting and stretching movement of the head and neck of a during normal or routine performance of the movements needed for engaging in a particular activity. However, when the head and neck of the user are subjected to an extraordinary impact or forces that may cause physiological injury to the user, the subject system and apparatus will desirably limit the rate and ranges of rotation, tilt, and compression or elongation of the head and neck relative to the chest, back and shoulders of a user when the head or body of the user.

The system and apparatus of the invention will desirably respond in real time as the impact or other forces are inflicted upon the user, thereby arresting movement of the head and neck within predetermined allowable limits and also damping the forces and distributing the damped forces throughout the body before physiological damage occurs. When .the forces are distributed or dissipated, the system and apparatus return to the original configuration, allowing routine movement as required for performance of the activity for which they are designed.

In one embodiment of the invention, a head and neck support and restraint system is disclosed that comprises protective headwear worn by a user of the system; an article worn about the shoulders, chest and back of the user (the "worn article"); and a dynamic connector disposed between and attached to the protective headwear and the worn article that supports the head and neck and dampens and distributes forces to which the head and neck of the user are subjected during use. Such forces can include forces experienced as a result of acceleration, deceleration, or impact during a collision between the user and another person or object during use. The dynamic connector will also desirably limit the rate and range of motion permitted between the head and neck relative to the shoulders, chest and back of a user when the head or body of the user is subjected to such forces.

In one embodiment, the subject apparatus includes a dynamic connector that desirably comprises a first end attachable to protective headwear of a user; a second end attachable to an article worn about the shoulders, chest and back of a user; and at least one rotation damper, at least one tilt damper and at least one elongation and compression damper disposed between the first and second end. In one embodiment of the invention, an elongate shaft also desirably extends between the first and second ends and passes through the at least one rotation damper, the at least one tilt damper, and the at least one elongation and compression damper. In another embodiment of the invention, the elongate shaft has a first portion that is flexible and a second portion that is relatively inflexible. The flexible portion desirably passes through the at least one rotation damper and the at least one tilt damper, and the relatively inflexible portion passes through the elongation-compression damper. One end of the flexible shaft is desirably coupled to an adjacent end of the inflexible shaft so that elongation or compression forces applied to the dynamic connector can be transmitted through the flexible and inflexible shafts to the elongation-compression damper of the dynamic connector.

The flexible shaft desirably comprises a cross-section that embodies one or more keys adapted for insertion into cooperatively aligned bores of the damping devices, some portions of which can have cooperatively configured keyways to facilitate rotational engagement at least between the flexible shaft and those portions of the rotational damper through which rotational forces imparted to the dynamic connector are communicated to facilitate damping and provide constraints as to the rate and range of permitted motion as discussed in greater detail below. The flexible shaft can be made by conventional means from any durable material, which can include for example a polymeric material that is generally suitable for such purposes, with a coefficient of elasticity, coefficient of elongation, flex modulus, glass transition temperature, impact resistance and service life that are consistent with the intended use and use environment.

If desired, at least one removable release mechanism such as a release pin is optionally provided for use in quickly and selectively detaching the subject apparatus from either or both of the protective headwear and the article worn by the user. If desired, a removable locking key is optionally provided that is engageable with the dynamic connector for use in selectively locking all major components of the apparatus into a fixed position relative to each other if, for example, it becomes desirable during an emergency situation to immobilize the head relative to the body of the wearer.

In one embodiment of the invention, a rotation damper is disclosed for use in the dynamic connector that further comprises a variable-response fluid damping valve in which two opposed internal paddles move through cooperatively configured fluid chambers containing a viscous fluid, displacing fluid from one chamber to another through at least one fluid passageway disposed in fluid communication with the two chambers. As used in relation to this embodiment of the invention, "variable response" refers to the resistance applied to flow of the viscous fluid inside the rotation damper by reason of the restricted cross-sectional area of the fluid passageway and the viscosity and incompressibility of the fluid.

In one embodiment of the invention, a variable response tilt damper is disclosed that desirably comprises at least one, and preferably a plurality of circumferentially spaced, interconnected flexible pouches disposed between two opposed discs, with each pouch containing a quantity of viscous fluid. When a portion of one disc is pressed closer to the other by flexure of a flexible shaft passing through the tilt damper, the viscous fluid disposed in the flexible pouch adjacent the area in which the closer movement occurs desirably offers increasing resistance to the tilt that is dependent upon factors such as the elasticity of the pouch material and the volume of fluid inside the pouch relative to the internal volume of the pouch. The ability of an individual pouch to distend into another area between the opposed discs is desirably limited by a support frame that defines boundary limits within which each pouch is confined during use of the apparatus. As used in relation to this embodiment of the invention, "variable response" refers to progressively greater resistance to tilting of one disc relative to the other due to the confinement and incompressible nature of the viscous fluid.

In one embodiment of the invention, an elongation and compression damper is disclosed that comprises a variable-response, double-acting piston and cylinder in which a piston reciprocates to force a viscous fluid back and forth between two cylinder chambers disposed on opposite sides of the piston through at least one fluid passageway in the piston that is in fluid communication with each of the two oppositely disposed chambers. The maximum elongation or compression of the dynamic connector is limited to the stroke length of the piston. The piston shaft is desirably inflexible and is coupled to an end of a flexible shaft portion that passes through at least one of a rotation damper and a tilt damper of the dynamic connector. As used in relation to this embodiment of the invention, "variable response" refers to the resistance applied to flow of the viscous fluid inside the elongation and compression damper by reason of the restricted cross-sectional area of the at least one fluid passageway through the piston and the viscosity and incompressibility of the viscous fluid disposed inside the two oppositely disposed cylinder chambers.

A satisfactory viscous fluid for use in at least some embodiments of the invention is a medium weight oily fluid that does not degrade or have any significant detrimental reaction with the materials from which the internal components of the rotation damper, tilt damper and elongation-compression damper of the apparatus of the invention are made.

In one embodiment of the invention, the dynamic connector disposed between and attached to the protective headwear and the worn article transmits the dampened forces originally received from the protective headwear through the point of attachment to the worn article, which then distributes those forces throughout the worn article in a method consistent with its physical configuration and the materials from which is it constructed to the shoulders, chest and back (collectively, "trunk," or "body" when differentiated from the head and neck) of the user, and through the skeleton and musculature of the user to the legs, feet and underlying support surface upon which the user is standing or resting. Depending upon the activity in which the user is engaged, the worn article may take on various physical configurations such as, for example, shoulder pads, a vest, pack, pack frame, reinforced jacket, or the like. The addition of a belt disposed around the waist can also distribute some forces directly to the pelvis and hips of the user, further lessening forces to be absorbed by the spine during use. In one embodiment of the invention, a force indicator is also included in the subject head and neck restraint system to alert users or medical personnel if the design limits of the system were exceeded by the concussive force to which the user was subjected.

Satisfactory devices for use in attaching the dynamic connector to protective headwear or to a worn article can include any known device or assembly capable of withstanding the forces expected to be encountered during use of the invention. Similarly, although satisfactory embodiments of the system and apparatus of the invention are disclosed here, other embodiments of the invention utilizing other similarly effective means for achieving the functional objectives disclosed here will become more apparent to those of ordinary skill in the art who have read this disclosure in view of the accompanying drawings, and it should be understood that the subject invention is not limited to the particular mechanical design disclosed in the accompanying detailed description of one embodiment.

These and other features and advantages of the present invention will become better understood from a consideration of the following detailed description of the preferred embodiments and appended claims in conjunction with the drawings.

BRIEF DESCRIPTION OF THE DRAWINGS

The system and apparatus of the invention are further described and explained in relation to the following drawings wherein.

DESCRIPTION OF THE PREFERRED EMBODIMENTS

Figure 1:
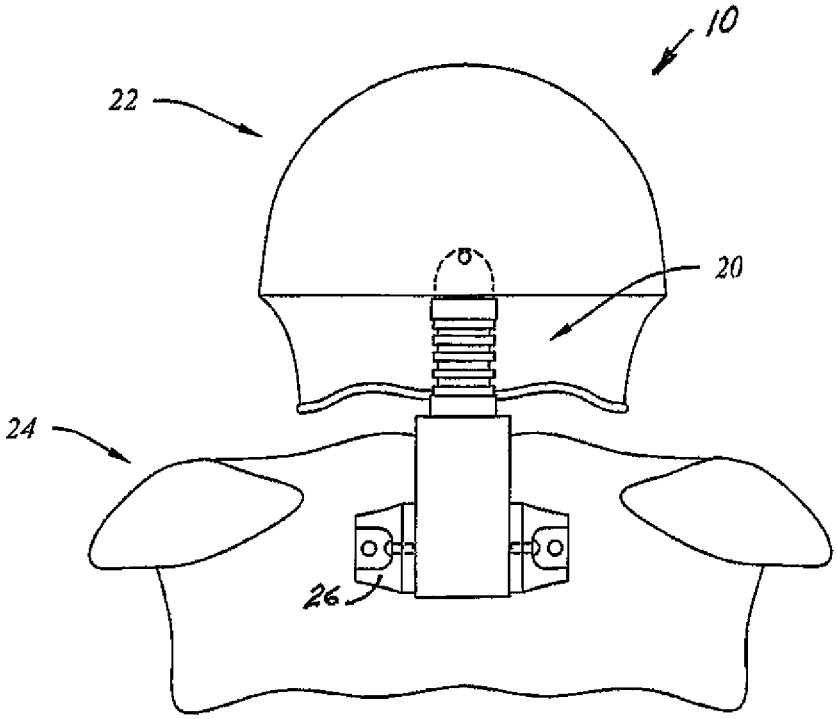
FIG. 1 is a simplified rear elevation view of one embodiment of the system of the invention.
Figure 2:
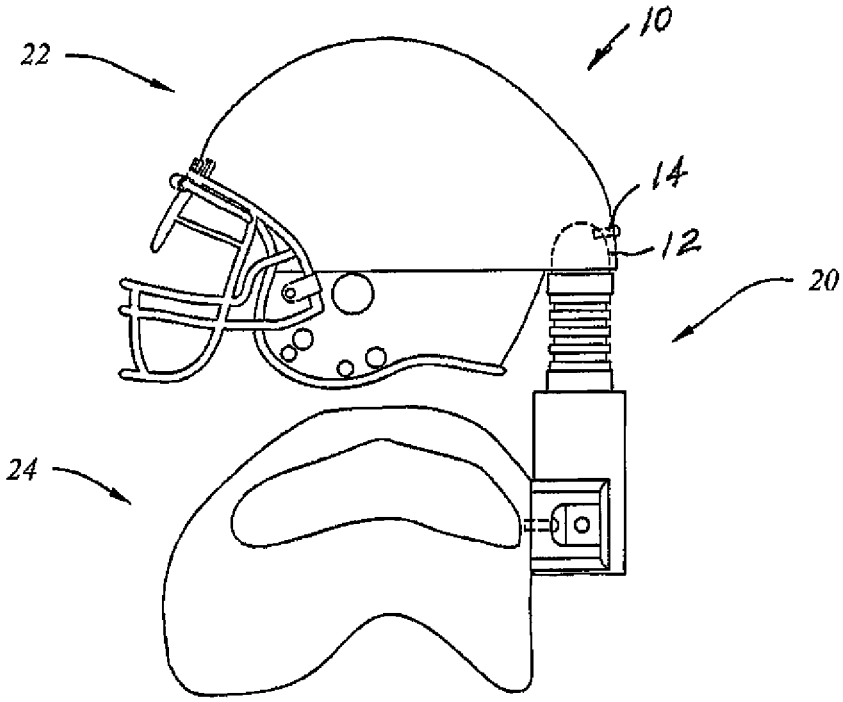
FIG. 2 is a side elevation view of the embodiment of FIG. 1.

Referring to FIGS. 1-2, a representative satisfactory embodiment of the subject head and neck support and restraint system 10 of the invention comprises football helmet 22 and shoulder pads 24 that can be releasably interconnected by dynamic connector 20. It should be understood, however, that football helmet 22 and shoulder pads 24 are merely illustrative of the many other types and varieties of protective headwear and articles such as vests, jackets, harnesses (collectively, "body wraps") that can be worn by a user and that can be assembled using a dynamic connector 20 to configure a satisfactory embodiment of the head and neck support and restraint system 10 of the invention. Such protective headwear and body wraps can be constructed using a wide variety of polymeric, metallic materials and fabric materials known by those of ordinary skill in the art to be suitable for use in such applications.

Of particular interest in relation to the embodiment of the invention depicted in FIGS. 1 and 2, the top end of dynamic connector 20 plugs into a socket 12 (best seen in FIG. 2) that is molded or otherwise provided in the back of helmet 22 to facilitate releasable attachment of the two. Also, it will be observed upon reading this disclosure that bracket 26 is provided for the releasable attachment of dynamic connector 20 to shoulder pads 24. Although conventional football shoulder pads rest on the shoulders of the user, they are "worn" by the user in the sense that they are often laced in front around the upper chest of the user, and thereby also constitute a "body wrap" that constricts around the back and trunk portion of the body of the user. Many conventional attachment systems and devices are available that can be readily used or modified for use with particular headwear and body wraps.

Desirably, head and neck support and restraint system 10 of the invention can be designed, fabricated and tailored to a particular activity and user demographic so that it will not be burdensome to wear when a user is participating in normal, routine performance of an activity where there is some risk of being subjected occasionally to a concussive force but where the user is more often interested in being able to move relatively freely and without undue constriction. For activities involving higher risk of physiological injury due to concussive forces, the subject invention will understandably be configured to be more durable and may provide somewhat greater limitations to a user's ability to move naturally while wearing the apparatus. Because the weight of helmet 22 is primarily supported by dynamic connector 20, the combined weight of the head and helmet are not supported by the neck as with conventional protective headwear, and helmet 22 does not contribute to the dynamic load transmitted to and through the neck either during normal use or when helmet 22 is subjected to a concussive force.

Figure 3:
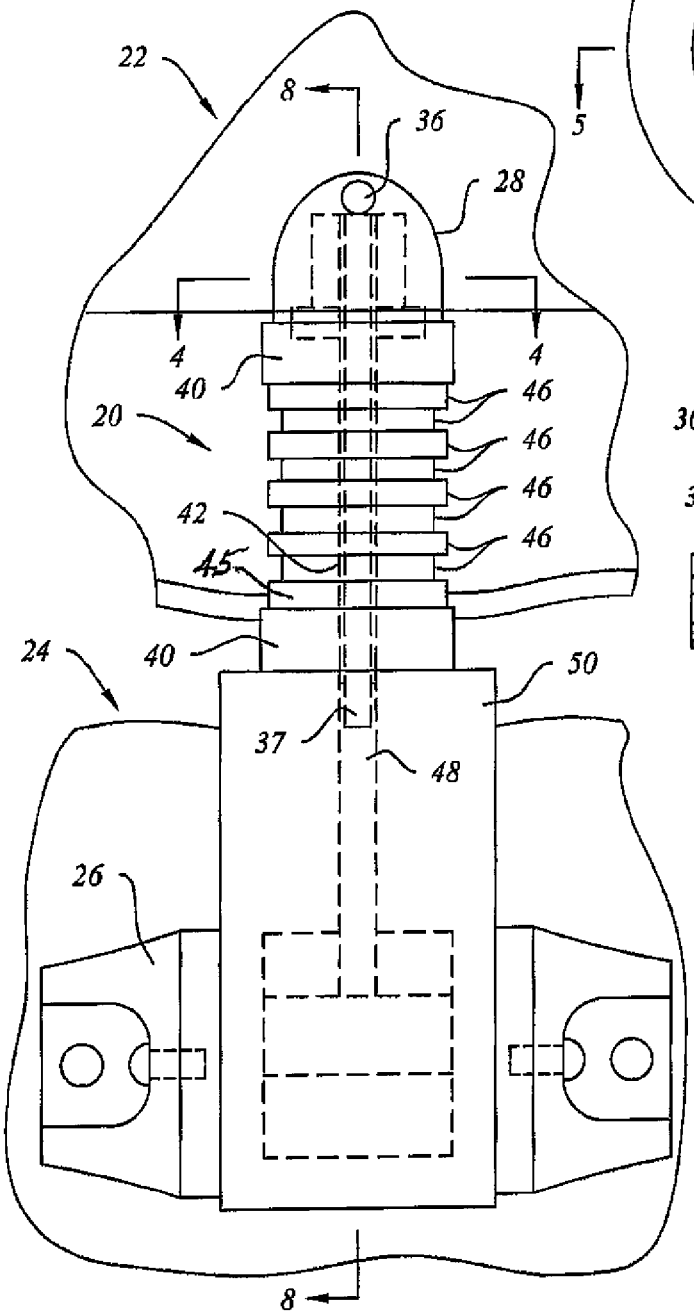
FIG. 3 is an enlarged rear elevation view of the dynamic connector of the embodiment of FIG. 1.

Referring to FIGS. 1-3, dynamic connector 20 is desirably attached to helmet 22 and shoulder pads 24 by a spring-loaded, quick-release connector pin 14 (FIG. 2) and connector bracket 26 (FIG. 1), respectively. Referring to FIG. 3, dynamic connector 20 desirably further comprises at least one, and preferably two or more rotation dampers 40. In the embodiment shown, rotation dampers 40 are spaced apart near the upper and lower ends of dynamic connector 20, with a plurality of tilt dampers 46 disposed between them. Flexible shaft 42 extends through the coaxially aligned rotation dampers 40 and tilt dampers 46 to facilitate tilting movement of helmet 22 in relation to the longitudinal axis through the center of elongation-compression damper 50.

As used in this disclosure in relation to the presently described embodiment of the invention, "tilt" and "tilting" should be understood to include movement of the head and neck of the user in any direction away from a longitudinal axis through the center of the coaxially aligned elements of elongation-compression damper 50 of dynamic connector 20. When dynamic connector 20 is vertically disposed as shown in FIG. 2, "tilt" or "tilting" refers to movement of helmet 22 in a direction that tips or leans forward, backward, left, right, or in any other intermediate direction from the longitudinal axis through elongation-compression damper 50 (FIG. 3). When dynamic connector 20 is horizontally disposed, as might occur for example when the upper body of a football player is parallel to the ground, "tilt" or "tilting" is still movement of helmet 20 in any direction away from the longitudinal axis through elongation-compression damper 50. "Tilting" is distinguished from "rotation" of helmet 22 relative to shoulder pads 24 in that "rotation" refers to movement of helmet 22 around the longitudinal axis.

Elongation-compression damper 50 of dynamic connector 20 controls and limits the rate and range of response when dynamic connector 20 is subjected to elongation or compression due to concussive forces imparted to helmet 22. Elongation-compression damper 50 is useful in damping concussive forces that are imparted to helmet 20 from any direction having a component force vector along the longitudinal axis through the device. A significant advantage of the present invention is that the rotation dampers 40, tilt dampers 46, and elongation-compression damper 50 of dynamic connector 20 are configured so as to limit both the rate and range of travel of helmet 22 relative to shoulder pads 24 when subjected to a high intensity concussive force. The structure and operation of one embodiment of each of rotation dampers 40, tilt dampers 46 and elongation-compression damper 50 are further described and explained in relation to FIGS. 6-20 below.

Figure 4:
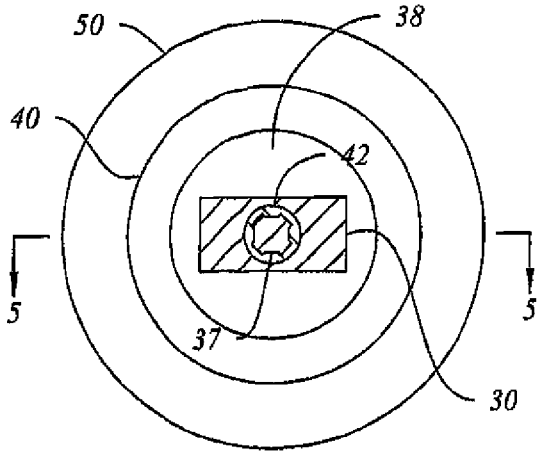
FIG. 4 is an enlarged plan view of the dynamic connector of FIG. 3 with the top cover removed.
Figure 5:
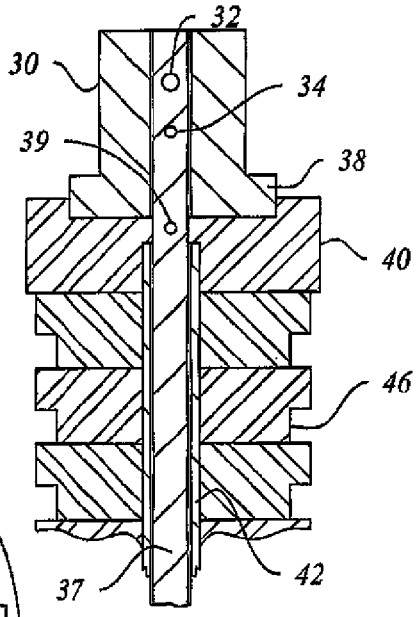
FIG. 5 is a cross-sectional elevation view, partially broken away, taken along line 5-5 of FIG. 4.
Figure 6:
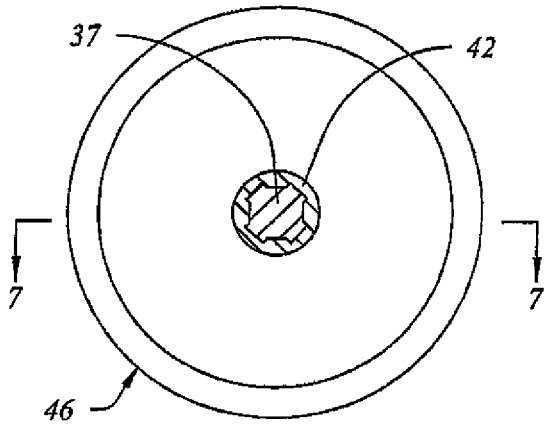
FIG. 6 is a plan view of a plurality of tilt dampers of the invention as viewed along line 6-6 of FIG. 7.
Figure 7:
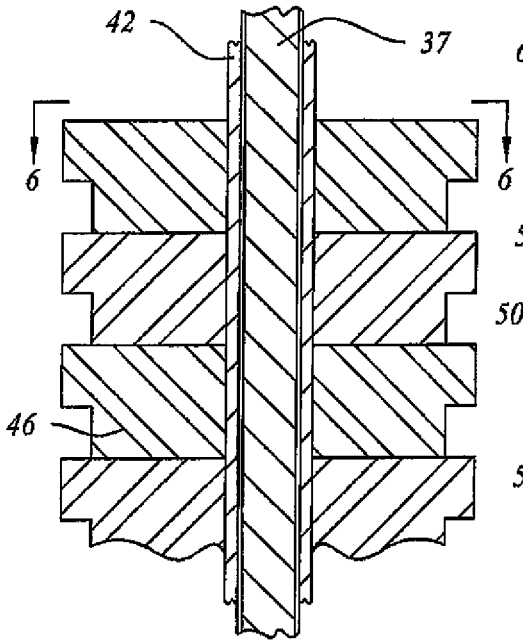
FIG. 7 is a simplified cross-sectional elevation view of a plurality of tilt dampers installed on a flexible shaft as viewed along line 7-7 of FIG. 6 but not showing the internal configuration of tilt dampers 46.

Referring to FIGS. 3-5, helmet mount fixture 30 is desirably configured to slidably engage and be releasably attachable to helmet 22. Base 38 of helmet mount fixture 30 is seated at the top of upper rotating damper 40 and contains a longitudinal bore through which flexible shaft 37 is insertable, passing downwardly sequentially through upper rotating damper 40, a plurality of tilt dampers 46, lower rotating damper 40, and impact force indicator disc 45 (FIG. 3). Although impact force indicator disc 45 is depicted here as being disposed between the lowest tilt damper 46 and the lower of two rotation dampers 40, it can similarly be positioned anywhere along the stem of dynamic connector 20 for use in the invention. Impact force indicator disc 45 can be made satisfactorily using metallic or polymeric materials appropriate to the intended use, or a combination thereof, and desirably includes one or more sensors that sense and transmit real-time impact data wirelessly to a receiver and recorder.

Flexible shaft 37 is desirably constructed of a durable, extrudable polymeric material that will flex but not fracture when subjected to the range of torsional, flexural, tensile and compression loadings likely to be encountered during use. Flexible shaft 37 desirably has a non-circular cross-section that is engageable with an inwardly facing collar inside each rotation damper 46 as flexible shaft 37 is inserted through the aligned longitudinal bores of the constituent elements of dynamic connector 20. A cylindrical packing 42 or functionally equivalent sealant layer is desirably provided where flexible shaft 37 passes through fluid-containing rotating dampers 40 and tilt dampers 46. The upper end of flexible shaft 37 is desirably connected to helmet mounting fixture 30 by one or more pins 32, 34, 39, with one or both of pins 32, 34 also being available for use in attaching helmet mounting fixture 30 to helmet 22. If desired, a locking key can also be provided to enable medical personnel to secure and immobilize helmet 22 and the head and neck of a user in an optimal position to allow transport of the user without movement of the head and neck relative to the shoulders following a concussion or other injury. Such a locking key is desirably insertable through a longitudinally extending keyway that can be internal to and coaxially aligned with, or offset from, flexible shaft 37.

Figure 8:
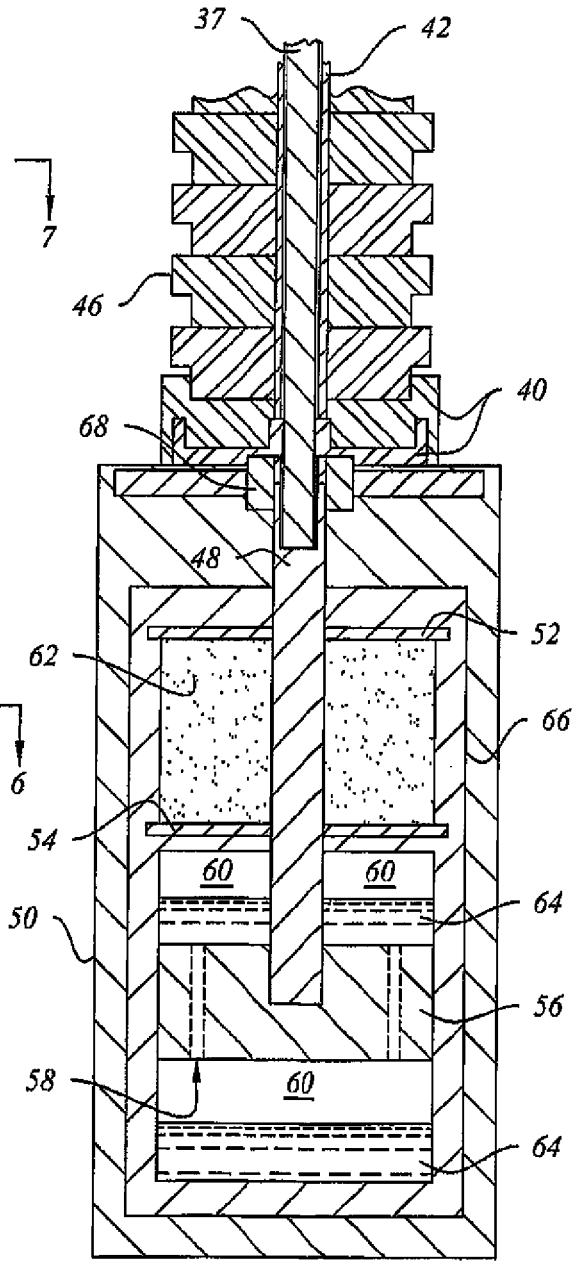
FIG. 8 is an enlarged cross-sectional elevation view of the lower portion of the dynamic connector of the embodiment of FIG. 1 as viewed along line 8-8 of FIG. 3.

Referring to the embodiment of the present invention that is shown in FIGS. 3 and 8, elongation-compression damper 50 is disposed at the base of dynamic connector 20. An elongation-compression damper 50 that is satisfactory for use in the invention comprises a mounting disk and coupling 68 near the uppermost end that attaches the lower end of flexible shaft 37 to the upper end of piston rod 48. Piston rod 48 is in turn coupled in fixed relation to piston 56, which further comprises at least one fluid passageway 58. Piston 56 is desirably a double-acting piston disposed inside cylinder 60, which also contains a predetermined volume of an oily or oil-like fluid 64 that does not completely fill the voids inside cylinder 60 and fluid passageway(s) 58. Fluid seal 56 is desirably disposed above cylinder 62, and is maintained by keeper rings 52, 54.

Elongation-compression damper 50 is configured to damp forces imparted to dynamic connector 20 that have component forces acting in the longitudinal direction that act either to elongate or compress the connector. In the absence of the invention, a significant portion of an impact received on the crown of an item of protective headwear is transmitted through the cervical vertebrae to the spine. One purpose and intended function of dynamic connector 20 and, more particularly, of elongation-compression damper 50 is to take that load away from the neck and reduce the magnitude of the force before distributing it to the body through a worn article to which the lower end of dynamic connector 20 is attached. The force is dissipated by using a significant portion of the energy applied through piston rod 48 to drive double-acting piston 56 inside cylinder 60 while simultaneously displacing fluid 64, preferably a medium viscosity oil, through one or more fluid passageways 58 in piston 56 to the other side of cylinder 60. The maximum range of travel of piston rod 48 is determined by the overall length of cylinder 60 less the thickness of piston 56.

Figure 9:
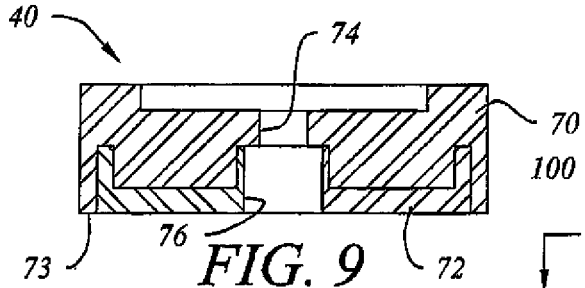
FIG. 9 is a cross-sectional elevation view of an assembled rotation damper.
Figure 10:
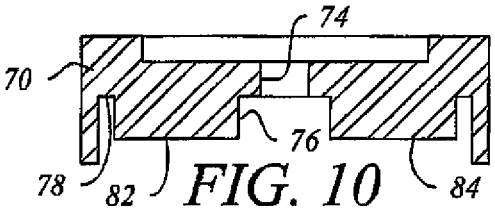
FIG. 10 is a cross-sectional elevation view of the cap of the rotation damper of FIG. 9 as taken along line 10-10 of FIG. 11.
Figure 11:
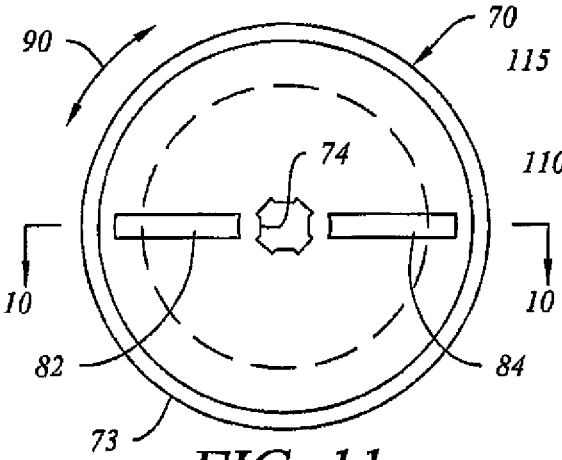
FIG. 11 is a bottom plan view of the cap portion of the rotation damper of FIG. 10.
Figure 12:
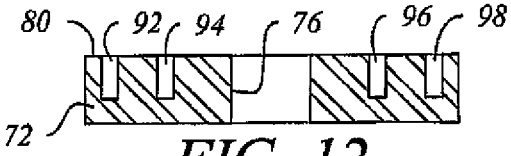
FIG. 12 is a cross-sectional elevation view of the base of the rotation damper of FIG. 9 as viewed along line 12-12 of FIG. 13.
Figure 13:
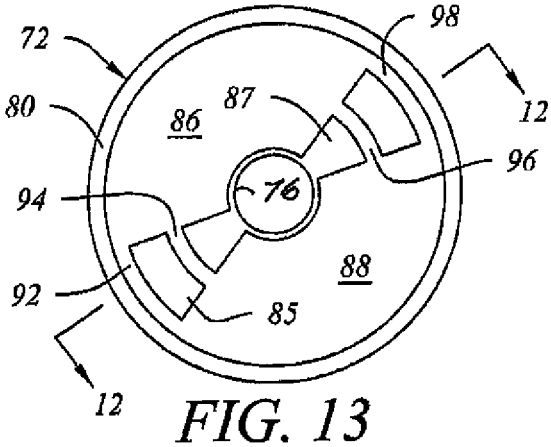
FIG. 13 is a plan view of the base of the rotation damper of FIG. 9.

Referring to FIGS. 9-13, each rotation damper 40 preferably further comprises cap 70 and base 72, each of which has a circular shape, with the outside diameter of cap 70 being slightly greater than the outside diameter of base 72 to facilitated fluid-tight slip-fit engagement between them. In the depicted embodiment, cap 70 comprises annular recess 78 into which annular rim 80 can slide into engagement when assembled as shown in FIG. 9. Both cap 70 and base 72 also have centrally disposed longitudinal bores 74, 76, with the bore of cap 70 being smaller than that through base 72. As seen in FIG. 11, bore 74 of cap 70 is configured in size and shape to receive flexible shaft 37 (FIG. 3) into slidable engagement with it, while bore 76 of base 72 is large enough to permit shaft 37 to spin inside it when cap 70 and base 72 are assembled as shown in FIG. 9. The rotation of cap 70 in either rotational direction relative to base 72 is indicated by arrow 90 of FIG. 11. FIGS. 10 and 11 further comprise diametrically opposed blades or paddles 82, 84 that sweep through cooperatively configured interior chambers 86, 88 of base 72 when cap 70 and base 72 are assembled as depicted in FIG. 9. When in use, rotation damper 40 will desirably contain an oily or oil-like fluid (not shown) that is disposed in chambers 86, 88 of base 72. It will also be appreciated that fluid seals (not shown) are desirably provided to prevent or control fluid leakage between cap 70 and base 72, and around the bores 74, 76. Referring to FIGS. 9-13, when rotation damper 40 is subjected to rotational loading by the engagement of flexible shaft 37 (FIG. 3) with bore 74 as helmet 22 is rotated left or right relative to shoulder pads 24 (FIG. 3), paddles 84, 84 force fluid disposed in chambers 86, 88 of base 72, forcing fluid through fluid passageways 92, 94, 96, 98 as seen in FIGS. 12 and 13.

In each instance where dynamic loading of dynamic connector 20 produces relative motion that causes fluid inside rotation damper 40 or elongation-compression damper 50 to be pushed through fluid passageways, it will be appreciated that the magnitude of damping will vary according to factors such as, for example, the number, cross-sectional area and surface configuration of the associated fluid passageways, the molecular weight, viscosity and lubricity of the fluid used, and the rate of movement of the paddle 82, 84 or piston 56 that is displacing the fluid. It will also be apparent to those of skill in the art upon reading this disclosure that those factors can be adjusted as needed in accordance with load factors likely to be encountered for a targeted activity, use environment and user demographic.

Figure 14:
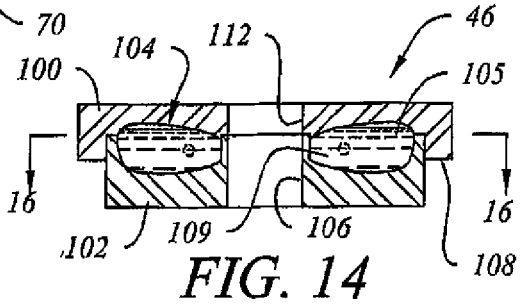
FIG. 14 is a cross-sectional elevation view of an assembled tilt damper as viewed along line 14-14 of FIG. 16.
Figure 15:
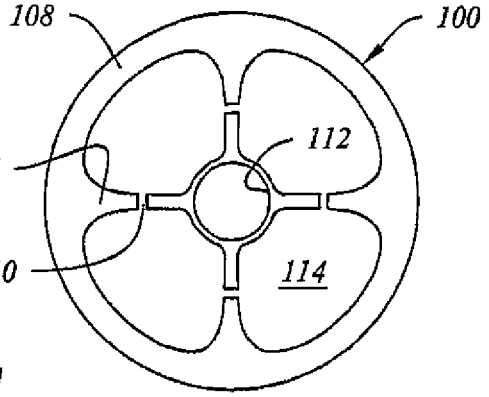
FIG. 15 is a bottom plan view of the cap of FIG. 14.
Figure 16:
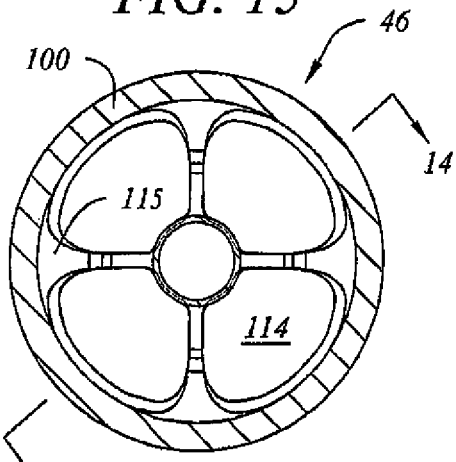
FIG. 16 is a cross-sectional plan view taken along line 16-16 of FIG. 14.
Figure 17:
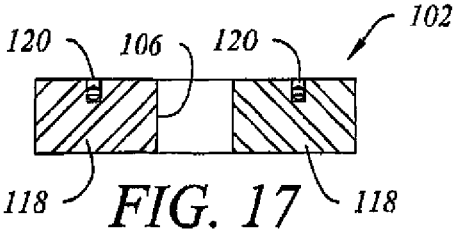
FIG. 17 is a cross-sectional elevation view of the base of FIG. 14 as viewed along line 17-17 of FIG. 18.
Figure 18:
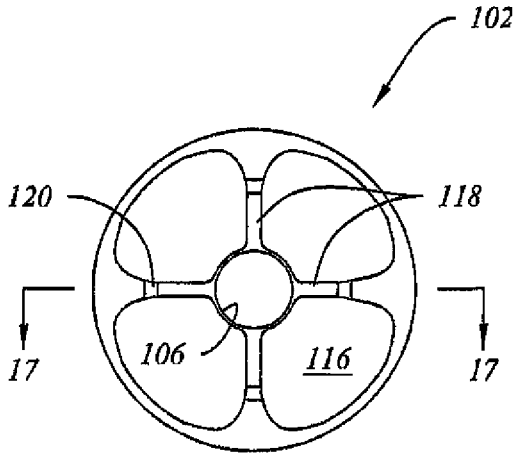
FIG. 18 is a plan view of the base of FIG. 14.
Figure 19:
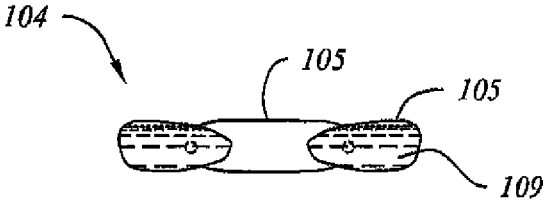
FIG. 19 is a simplified cross-sectional elevation view of the pouch ring of the tilt damper of FIG. 14 taken along line 19-19 of FIG. 20.
Figure 20:
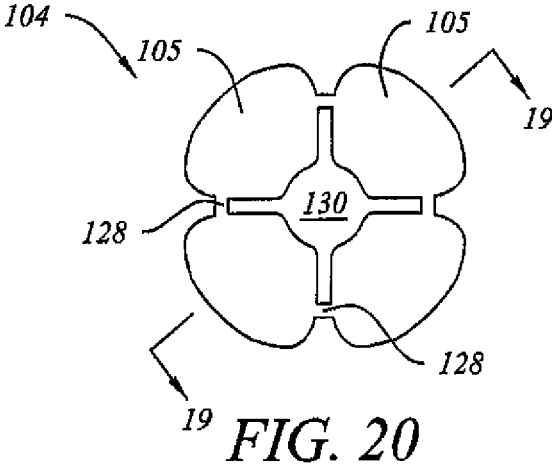
FIG. 20 is a plan view of the pouch ring of the tilt damper of FIG. 14. The drawings are not to scale and the relative proportionality and scale of like-numbered elements sometimes varies in different Figures of the drawings.

Referring to FIGS. 14-20, each of a plurality of tilt dampers 46 as disclosed in relation to this embodiment of the invention further comprises cap 100, base 102 that are cooperatively configured to be assembled into slip-fit engagement with each other, with a ring 104 of interconnected, impact-absorbing pouches 105 disposed between them. Sufficient diametric clearance is desirably provided between cap 100 and base 102 of each tilt damper 46 that each cap 100 can tilt slightly in relation to the cooperatively engaged base 102 to permit some compression of a pouch 105 disposed between them in that portion of the circumference in which the tilting pressure is applied by flexure of flexible shaft 37 (FIG. 3) relative to a centrally disposed longitudinal axis through elongation-compression damper 50 (FIG. 3). Referring to FIG. 15, cap 100 further comprises annular rim 108 that cooperates with a plurality of evenly spaced, radially extending ribs (or spokes) 115 to define the upper portion of a plurality of recesses 114. Transverse openings 110 are desirably provided in each rib 115 to provide clearance for connectors 128 between adjacent pouches 105 of pouch ring 104 (FIGS. 14 and 19-20). Referring to FIGS. 17-18, base 102 further comprises an annular rim cooperatively configured to fit inside rim 108 of cap 100 (FIG. 14). Base 102 further comprises a plurality of evenly spaced, radially extending ribs 118 that define recesses 116 that cooperate with recesses 114 of cap 100 to receive pouches 105 of pouch ring 104 when assembled as depicted in FIG. 14. Centrally disposed axial bores 112 through cap 100, 106 through base 102 and aperture 130 through pouch ring 104 are all desirably cooperatively aligned and are sized and configured to allow flexible shaft 37 (FIG. 3) to pass through them. An oily or oil-like fluid 109 is desirably confined inside pouch ring 104 to provide cushioning and resistance to a force applied downwardly through dynamic connector 20 or by flexure of shaft 37 relative to shoulder pads 24 (FIG. 3).

Those of ordinary skill in the art will also appreciate upon reading this specification and the description of preferred embodiments herein that modifications and alterations to the apparatus and methods may be made within the scope of the invention and it is intended that the scope of the invention disclosed herein be limited only by the broadest interpretation of the appended claims to which the inventor is legally entitled.

I claim:

1. A head and neck support and restraint system for supporting and protecting the head, neck and body of a user from the effects of a concussive force applied from an external source that imparts a rate and range of motion to the head and neck relative to the body, the system comprising:

a first article of protective headwear;

a second article worn about the body; and a dynamic connector comprising a first end attachable to the first article, a second end attached to the second article, and at least one rotation damper, at least one tilt damper, and an elongation-compression damper disposed between the first and second ends;

wherein the first article, the dynamic connector and the second article cooperate to damp the concussive force, limit the rate and range of motion imparted to the head and neck relative to the body in response to the concussive force, and distribute the damped concussive force through the second article to the body.

2. The head and neck support and restraint system of claim 1 wherein the first article of protective headwear is a helmet.

3. The head and neck support and restraint system of claim 1 wherein the second article is a set of shoulder pads.

4. The head and neck support and restraint system of claim 1 wherein the second article is a vest.

5. The head and neck support and restraint system of claim 1 wherein the dynamic connector comprises a flexible shaft that extends through the rotation damper.

6. The head and neck support and restraint system of claim 1 wherein the dynamic connector comprises a flexible shaft that extends through the tilt damper.

7. The head and neck support and restraint system of claim 1 wherein the first end of the dynamic connector is releasably attachable to the first article.

8. The head and neck support and restraint system of claim 1 wherein the second end of the dynamic connector is releasably attachable to the second article.

9. The head and neck support and restraint system of claim 1 wherein the concussive force is a force applied to the first article.

10. The head and neck support and restraint system of claim 1 wherein the concussive force is a force applied to the second article.

11. The head and neck support and restraint system of claim 1 wherein the concussive force is a force applied to the body of the user.

12. The head and neck support and restraint system of claim 1 wherein the concussive force arises from one of acceleration, deceleration or impact.

13. The head and neck support and restraint system of claim 1, further comprising a force indicator.

14. The head and neck support and restraint system of claim 1 wherein the rotation damper comprises a variable-response fluid damping valve.

15. The head and neck support and restraint system of claim 1 wherein the rotation damper comprises two cooperatively engageable housing members defining at least two circumferentially spaced, cooperatively configured fluid chambers each containing an oily fluid and separated by at least one fluid passageway, and a fluid displacement member disposed in each of the at least two chambers that is configured to sweep through the respective chamber in response to a rotational component of a force applied to the dynamic connector, thereby displacing a portion of the oily fluid from one chamber to another through the at least one fluid passageway.

16. The head and neck support and restraint system of claim I wherein the tilt damper is a variable response tilt damper comprising at least two circumferentially spaced, interconnected flexible pouches disposed between two opposed discs, with each pouch containing a quantity of oily fluid, the two opposed discs and the flexible pouches being configured in such manner that when a portion of one disc is pressed closer to the other disc by tilting movement of the dynamic connector in response to a tilting component of a force applied to the dynamic connector, the oily fluid disposed inside a flexible pouch adjacent to the pressed disc provides increasing resistance to the tilting movement.

17. The head and neck support and restraint system of claim 1 wherein the elongation-compression damper comprises a housing having two cylinder chambers disposed on opposite sides of a double-acting piston attached to an inflexible shaft that is coupled to a flexible shaft passing through the dynamic connector, the two cylinder chambers each containing a portion of oily fluid and at least one fluid passageway connecting the two chambers, wherein the piston reciprocates to force the oily fluid back and forth between two cylinder chambers in response to elongation or compression forces imparted to the dynamic connector during movement of the head and neck relative to the body of the user.

18. A dynamic connector useful for supporting and restraining the head and neck of a user, comprising:

a first end attachable to protective headwear worn by the user;

a second end attached to an article worn on the body of the user, and at least one rotation damper, at least one tilt damper, and an elongation-compression damper disposed between the first and second ends;

wherein the dynamic connector damps a concussive force directed against the user, limits the rate and range of motion imparted to the head and neck relative to the body in response to the concussive force, and distributes the damped concussive force through the article to the body.

19. The dynamic connector of claim 18 wherein the concussive force arises from one of acceleration, deceleration and impact.

20. The dynamic connector of claim 18, further comprising a force indicator.

* * * * *